United States Patent [19]

Aspaas

[11] 4,084,361

[45] Apr. 18, 1978

[54] FRAME AND SASH FOR DOORS AND WINDOWS

[76] Inventor: Finn Aspaas, 19 Tollbodgt, 4600 Kristiansand S, Norway

[21] Appl. No.: 706,997

[22] Filed: Jul. 20, 1976

[30] Foreign Application Priority Data

Jan. 14, 1976 Norway ..... 760125

[51] Int. Cl.[2] ..... E06B 3/00

[52] U.S. Cl. ..... 52/204; 49/501; 49/504; 49/DIG. 1

[58] Field of Search ..... 52/204, 731, 309, 235, 52/588; 49/381, 397, 501, 504, DIG. 1, 390

[56] References Cited

U.S. PATENT DOCUMENTS

| | | | |
|---|---|---|---|
| 3,555,735 | 1/1971 | Weikert | 49/501 |
| 3,557,514 | 1/1971 | Fahrni | 49/504 X |
| 3,703,063 | 11/1972 | Budich et al. | 52/204 X |

FOREIGN PATENT DOCUMENTS

| | | | |
|---|---|---|---|
| 2,002,838 | 8/1971 | Germany | 49/504 |
| 2,002,862 | 8/1971 | Germany | 49/504 |
| 2,235,790 | 1/1974 | Germany | 49/DIG. 1 |
| 2,313,662 | 10/1973 | Germany | 52/204 |

*Primary Examiner*—J. Karl Bell

*Attorney, Agent, or Firm*—William Anthony Drucker

[57] ABSTRACT

A frame and sash construction for doors and windows has profiled beams of chair-shaped cross-section, the improvement being that an opening of an elongated slot in a foremost leg portion is directed upwardly towards a seat portion to receive a sealing gasket forming a packing for a window glass or mounting ledge. A backrest portion has a greater height than a rear leg portion. The seat portion is formed with a pair of ribs with opposed flanges to receive locking rods or hinge plates, and the sides of the leg portions facing each other have parallel grooves to receive ribs of the gaskets.

5 Claims, 3 Drawing Figures

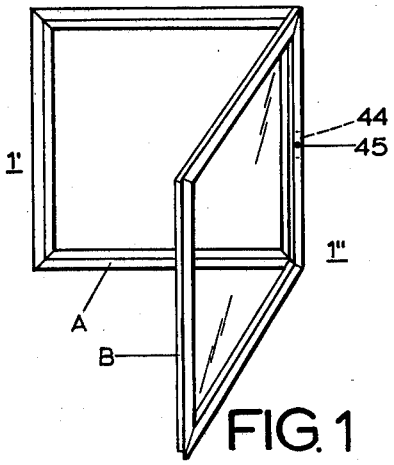
FIG. 1
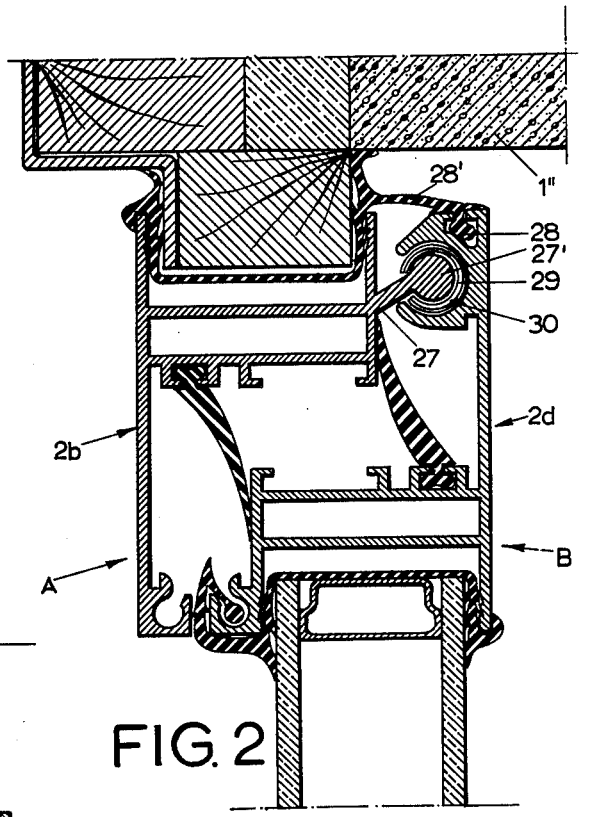
FIG. 2
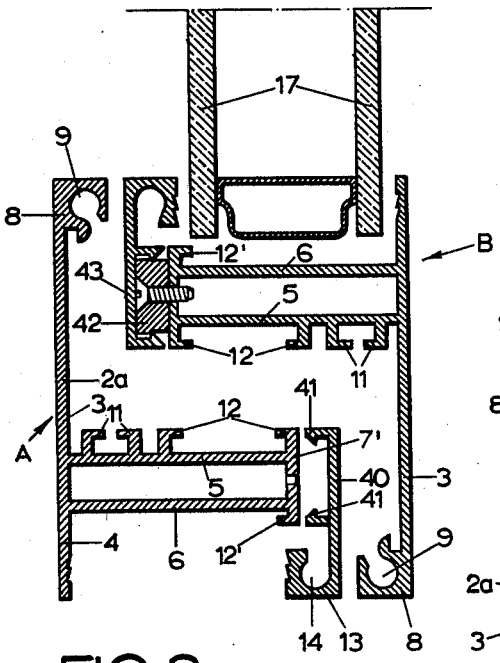
FIG. 3
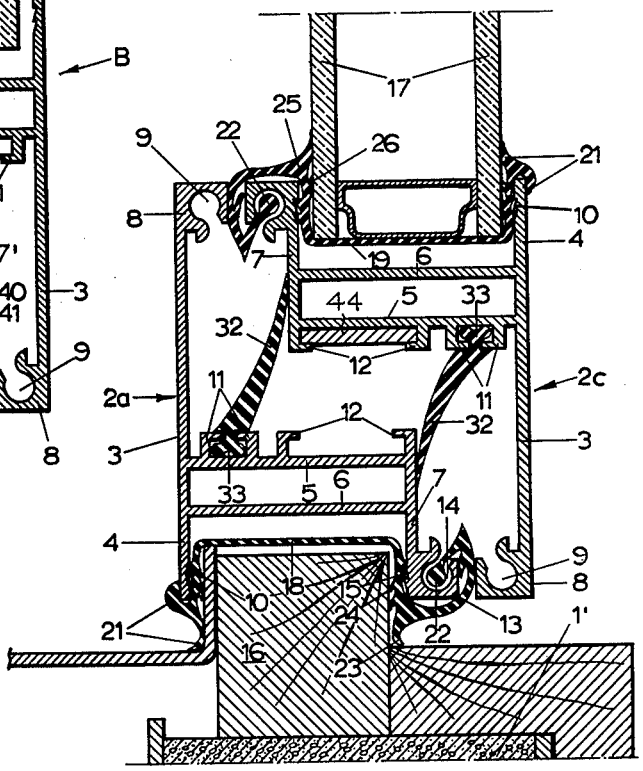

FRAME AND SASH FOR DOORS AND WINDOWS

This invention relates to a frame and sash for doors or windows produced from beams of similar profile having a "chair-shaped" or h-shaped cross-section. From the "chain seat portion" of the beam there protrude ribs having flanges facing each other and defining a substantially dove tail-shaped slot for receiving the foot portion of a strip, the free edge portion of which strip is intended to resiliently contact another opposed beam. The "seat portion" together with the "leg portions" of the beam, and a wall located between the "leg portions" and beneath the "seat portion", define a longitudinal channel, and the free edge of the front "leg portion" of the beam is formed with an elongated slot.

A profiled beam of this kind is used for production of a window frame and also of a window sash, the two beams being placed one against the other with one of them turned in relation to the other. In the sash, the longitudinal opening which is defined by the "chair legs" of the beam and the underside of the seat receives the window pane. In the frame it receives a mounting member arranged around the window opening. When the beams are used in this way, the outer width of the window sash and of the window frame will be the same, so that the window, as seen from the outside and from the inside, will have the same appearance — i.e. the width and length of the single profiles — as a window which is fixedly mounted, in spite of the sash being hinged to the frame.

According to the invention the opening of said elongated slot is directed upwardly towards the "seat portion" and serves to receive the thickened portion of a sealing gasket formed with elongated lips and arranged in said slot which is defined by said two "leg portions" and the said wall and around the free edge of the rear "leg portion" of the profiled beam, said gasket forming a packing for the edge of a plate-shaped element (window pane) or a mounting ledge. The "backrest portion" has a greater height than the rear "leg portion". The "seat portion" is formed with a further pair of ribs having flanges facing each other and intended to receive locking rods and/or hinge plates. The sides of said two "leg portions" facing each other are provided with parallel grooves to cooperate with ribs or lips of the said gasket.

There is thus obtained a profiled beam which is very simple to assemble and which satisfies all demands on insulation and interruption of the cold bridge.

The profiled beam forming the hinge side of a frame is preferably in addition thereto formed with a ledge protruding from the front side of the foremost "leg portion" and ending in a cylindrical bead or thickening. The profile beam forming the hinge side of the sash cooperating with the frame, along the edge of the "backrest portion", is additionally formed with a groove having a circular cross-section and an opening towards the "seat portion" of the profile beam, and serves to receive the cylindrical bead or thickening of the first mentioned ledge for together with same to form a hinge between the frame and the sash.

A special advantage of the embodiment of these hingeing edge profiles is that the diameter of the bead or thickening is equal to, or smaller than, the opening of the groove, in order to receive between said thickening and said groove a lining having the form of a hollow cylinder with a longitudinal opening in accordance with the opening of the groove, and with the wall thickness corresponding with the radial distance between the inner wall of the groove and the thickening.

This construction permits especially simple assembly, in that a portion of the ledge with the thickening is cut away at a place near the mid-portion of the profile beam, whereupon there is pushed into the groove from its end a cylindrical portion the length of which corresponds with the length of the cut-out portion of the ledge with thickening. Thereafter the thickening on the sash profile beam is introduced into the opening of the circular groove so that the cylindrical portion will be located flush with the thickening. The frame and sash profile beams or the sash and frame respectively, are moved to their correct position, whereupon the cylindrical portion is fixed by means of a set screw, a bit or the like, and a hollow cylindrical lining is finally pushed in from both ends of the groove for abutment with the cylindrical portion.

Preferably the foremost "leg portion" is detachably fixed to the front side of the "seat portion", there being fixed to this front side a ledge of heat insulating, preferably resilient material to which the detachable foremost "leg portion" is fixed by snap action.

An embodiment of the invention is described with reference to the accompanying drawing, in which FIG. 1 shows a window in open, out-turned position, FIG. 2 shows a horizontal section of a frame and a sash mounted in the window opening, and FIG. 3 shows an alternative.

According to FIG. 2 the window opening is defined by two parts 1' and 1'' of a building.

In FIG. 2 there are shown two identical equal chair-shaped or h-profile beams, of which the first beam **2*a* forms a window frame A and the second 2*c* forms a window sash B. As shown, said two profile beams are so arranged that one of them is turned 180° in relation to the other, and they are placed juxtaposed to each other so as to form together a substantially rectangular profile. The rear "leg portion" of each profile is numbered 4 and its foremost "leg portion" is numbered 7, the "seat portion" is numbered 5 and the "backrest portion" is numbered 3. Below the "seat portion" 5 and between both "leg portions" 4 and 7 there is arranged a longitudinal wall 6 which, together with the "seat portion" 5 and the "leg portions" 4 and 7 define a closed channel 46** which is used for assembly of the corner portions of the frame and sash, respectively, there being introduced, in known manner, into the mitred ends of two abutting profiles a mounting member for assembling at a right angle. The clamping of said mounting piece (not shown) to the mitred ends of the profile may take place in any known manner, for instance by set screws, wedges, glue or the like.

Along the upper free edge 8 of the "backrest portion" there is formed a groove 9 with circular cross-section and the opening facing downwardly towards the "seat portion" 5. An elongated slot 14 is formed along the free edge portion 13 of the foremost "leg portion" 7. In the embodiment shown said groove 9 is not used, but may receive a weather strip for sealing against the edge portion 13 of the second beam **2*c*. The sealing gaskets 18 and 19, which are substantially equal, are constructed to receive either a mounting ledge 16 serving to keep the frame in place in the window opening 1', 1'', or a window pane 17**.

The gaskets 18 and 19 consist of a bead 22 of circular cross-section which is introduced into the elongated slot 14. Further, said gasket formed with sealing lips 21 and 25, and thickening which seal against the abutting edge 8 of the second beam 2c, against the opening in the building at 21 and 23, and with lips 24 which surround the ledge 16, and the edge of the window pane 17, and around the free edge of the rear "leg portion" 4.

At its inner side the rear "leg portion" 4 is formed with parallel grooves 10 and the foremost "leg portion" 7 with grooves 15 corresponding with the gaskets 18 and 19.

The lips 21 and 25 of the gasket 19 engage each face of the window pane 17, in order to prevent entry of water. The opposite sides of the gaskets 18 and 19 are formed with a pair of inclined lips 24, 26 serving for extra sealing of the window pane 17, which in the present case is a double pane, and of the mounted ledge 16.

The "chair seat" is formed with a pair or ribs 11 having mutually facing flanges which define a substantially dove tail-shaped groove for receiving a foot portion 33 of a strip 32, the free edge portion of which abuts the front face of the "leg portions" 7 of the respective profiles. Said strips 32 are resilient and serve, together with the sealing gaskets 18 and 19, for interruption of a cold bridge between the two beams 2a and 2c at two places.

From the "seat portion" 5 there protrudes two ribs 12 which are also provided with mutually facing flanges to define a slot for receiving locking rods 44 and/or hinge plates (not shown).

FIG. 3 shows an alternative in which the foremost "leg portion" 40 is detachably fixed to the front side of the "seat portion" 5. There is fixed to said front side, by means of screws 43, a ledge 42 of heat insulating material to which the foremost, detachable "leg portion" 40 is secured by snap action. The assembled profile thereby has the same appearance and effect as shown in FIG. 2, with the addition of an extra insulation between the "seat portion" 5 and the foremost "leg portion" 40. This brings with it the further advantage that the window pane, also in this case a double pane 17, may be placed and fixed after the window sash B has been assembled and possibly hinged to the frame A, in contrast to the case of the embodiment according to FIG. 2 in which the window pane is placed between the "leg portions" 4 and 7 of the profiles during assembling of the sash B.

As will be easily understood, the window sash B and the window frame A are produced as a whole from the same profile beam. If the sash is to be hinged to the frame, hinges may be arranged in known manner between the corresponding profile parts, which are fixed in known manner. However, the invention also provides the possibility of making the hinge parts in one piece with the profiles, as shown at the top of FIG. 2.

The profiled beam 2b forming the hinge side of the frame, is formed with a ledge 27 which protrudes at an inclination from the front side of the foremost "leg portion" 7 and terminates in a cylindrical bead or thickening 27'. Said ledge 27 and bead 27' form the first hinge part with a hinge spindle. The opposite profiled beam 2d, forming the hinge side of the sash, is formed along its "backrest portion" 3 with a groove 30 which faces the front side of the "chair" and has a circular cross-section for receiving the cylindrical bead portion 27' and forming the second hinge part. Furthermore, parallel to the groove 30 there is formed at the end of the "backrest portion" a further groove 28 which receives the thickened part of a lip-shaped weather strip 28'.

The bead or thickening 27' and the groove 30 may have the same diameter so that the hinge connection between the frame and the sash takes place in that the bead or thickening 27' of the sash is pushed into the groove 30 from one end. However, the invention permits substantially simpler and more favourable assembly if the diameter of the bead or thickening 27' is chosen equal to or slightly smaller than the width of the opening of the groove 30 so that the sash may be placed on the frame with the bead or thickening 27' falling into the groove 30, whereupon the parts are locked in relation to each other by means of a lining 29. Said lining has the form of a hollow cylinder with a longitudinal opening corresponding to the opening of the groove 30, and with a wall thickness corresponding with the radial distance or clearance between the bead or thickening 27' and the groove 30. Said lining is pushed into the clearance from the end and will thereby lock both profiles to each other. Said lining is preferably chosen of a material having self-lubricating properties, such as Nylon.

The assembly of the hinge connection preferably takes place in such a way that a part of the ledge 27 with the bead or thickening 27' is cut out substantially in the middle, whereupon there is pushed into the middle of the groove 30 a cylindrical portion 44 (indicated in FIG. 1) which is put in such a position that it will be located at the part of the groove 30 where the said cutting out of the cylindrical bead 27' will be located, when the hingeing is fulfilled. The sash profile is placed upon the frame profile, or the assembled sash B is placed so that the bead or thickening 27' enters the groove with the cylindrical portion 44 in position in said groove. Thereupon there is pushed in from each end a lining 29 which is preferably put in abutment with the cylindrical portion 44. Then, after both profile parts or the sash and the frame, respectively, have been correctly positioned in relation to each other, the lining 29 is fixed, for instance by a set screw 45, pin or the like introduced through holes in the wall of the groove 30 and through the cylindrical portion 44.

I claim:

1. In a frame and sash for doors and windows, composed of similar profiled beams having a chair-shaped cross-section including:

(i) a chair-seat portion with protruding ribs having respective opposed flanges and defining a substantially dove tail-shaped slot to receive a foot portion of a lip-shaped strip the free edge portion of which is intended to contact another opposed such beam (ii) a foremost leg portion having a free edge formed with an elongated slot, (iii) a rear leg portion, (iv) a longitudinal wall disposed between the leg portions and beneath the seat portion and defining with said leg portions and with said seat portion a longitudinal channel, (v) a backrest portion extending upwardly from said rear leg portion, the improvements that, in combination, (a) the opening of said elongated slot is directed upwardly towards said seat portion and serves to receive a bead of a sealing gasket formed with elongated lips and disposed in said elongated slot and about the free edge of the rear leg portion and between said foremost leg and rear leg, said gasket forming a packing for the edge of a respective plate-shaped window pane and mounting ledge entering between said foremost leg and rear leg, (b) the backrest portion has a greater height than the rear leg portion (c) the seat portion is formed with a further pair of ribs having opposed facing flanges, and (d) the sides of the two leg portions facing each other are provided with parallel grooves to cooperate with ribs of said sealing gasket.

2. A frame and sash, as claimed in claim 1, wherein a first said profiled beam to form a hinge side of a frame has a ledge protruding from the front side of the foremost leg portion and ending in a cylindrical bead, and wherein a second said profiled beam forming the hinge side of a sash cooperating with said frame is additionally formed along the edge of the backrest portion with a groove having a circular cross-section and opening towards the seat portion of the beam and serving to receive the cylindrical bead of the ledge so as together therewith to form a hinge between the frame and the sash.

3. A frame and sash, as claimed in claim 2, wherein the diameter of the bead is not greater than the opening of the groove in order to receive between said bead and said groove a lining in the form of a hollow cylinder with a longitudinal opening corresponding to the opening of the groove and a wall thickness corresponding to the radial distance between the inner wall of the groove and the bead.

4. A frame and sash, as claimed in claim 3, wherein the foremost leg portion is detachably secured to the front face of the seat portion, and wherein there is secured to said front face a ledge of heat insulating and selectively resilient material to which said detachable foremost leg portion is secured by snap action.

5. A method for establishing a hinge connection between selectively a sash and a sash profiled beam and a frame and a frame profiled beam as claimed in claim 3, comprising the steps of:

(i) cutting away, at a position near to the midportion of the profiled beam, a portion of the ledge with the bead (ii) pushing into the groove from the end thereof a cylindrical portion the length of which corresponds with the length of the cut out portion of the ledge with the bead, (iii) introducing the bead of the sash profiled beam into the opening of the circular groove so that the cylindrical portion becomes located flush with the bead (iv) moving selectively the frame and sash profile beams and the sash and frame to correct position, (v) securing the cylindrical portion (vi) pushing a hollow cylindrical lining inwards from both ends of the groove for abutment with the cylindrical portion.

* * * * *